US007082078B2

(12) United States Patent
Fripp et al.

(10) Patent No.: US 7,082,078 B2
(45) Date of Patent: Jul. 25, 2006

(54) MAGNETORHEOLOGICAL FLUID CONTROLLED MUD PULSER

(75) Inventors: Michael Fripp, Carrollton, TX (US); Neal G. Skinner, Lewisville, TX (US); Wilson C. Chin, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 175 days.

(21) Appl. No.: 10/634,577

(22) Filed: Aug. 5, 2003

(65) Prior Publication Data

US 2005/0028522 A1 Feb. 10, 2005

(51) Int. Cl.
*H04H 9/00* (2006.01)
*E21B 29/02* (2006.01)
*H01B 3/20* (2006.01)

(52) U.S. Cl. ..... 367/83; 166/66; 252/572; 175/61

(58) Field of Classification Search ..... 367/83–87; 340/853.3, 854.3, 854.4, 854.5; 166/122, 166/66.6, 66.5, 334.1
See application file for complete search history.

(56) References Cited

U.S. PATENT DOCUMENTS

| | | | | | |
|---|---|---|---|---|---|
| 3,227,228 | A | * | 1/1966 | Bannister | 175/4 |
| 4,785,300 | A | | 11/1988 | Chin et al. | 340/861 |
| 5,040,155 | A | | 8/1991 | Feld | 367/83 |
| 5,073,877 | A | | 12/1991 | Jeter | 367/84 |
| 5,115,415 | A | | 5/1992 | Mumby et al. | 367/83 |
| 5,294,923 | A | * | 3/1994 | Juergens et al. | 340/854.9 |
| 5,448,227 | A | * | 9/1995 | Orban et al. | 340/854.4 |
| 5,586,084 | A | | 12/1996 | Barron et al. | 424/401 |
| 5,636,178 | A | | 6/1997 | Ritter | 367/83 |
| 5,787,052 | A | | 7/1998 | Gardner et al. | 367/84 |
| 6,021,095 | A | * | 2/2000 | Tubel et al. | 367/82 |
| 6,219,301 | B1 | | 4/2001 | Moriarty | 367/84 |
| 6,257,356 | B1 | | 7/2001 | Wassell | 175/61 |
| 6,421,298 | B1 | | 7/2002 | Beattie et al. | 367/83 |
| 6,469,367 | B1 | | 10/2002 | Kondo et al. | 257/292 |
| 6,568,470 | B1 | * | 5/2003 | Goodson, Jr. et al. | 166/66.5 |
| 2003/0019622 | A1 | | 1/2003 | Goodson et al. | 166/66.5 |

* cited by examiner

*Primary Examiner*—Jeffery Hofsass
*Assistant Examiner*—Kimberly Jenkins
(74) *Attorney, Agent, or Firm*—Conley Rose, P.C.

(57) ABSTRACT

A mud pulser controlled by a field applied to an electroactive fluid. The electroactive fluid is employed to act as a rapid-response brake to slow or interrupt the rotation of a mud motor or mud siren, thus creating pressure pulses in a circulating fluid. In certain embodiments, the electroactive fluid is used as a direct brake acting on a shaft rotating in a volume of electroactive fluid where the shaft is coupled to the mud motor or siren. The application of a field to the electroactive fluid impedes the rotation of the shaft, thus slowing the mud motor and creating a pressure pulse in the circulating fluid. In another embodiment, a Moineau pump circulating an electroactive fluid is coupled to the mud motor. The application of a field to the electroactive fluid slows the rotation of the pump, thus slowing the mud motor and creating a pressure pulse in the circulating fluid.

24 Claims, 3 Drawing Sheets

MAGNETORHEOLOGICAL FLUID CONTROLLED MUD PULSER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The embodiments of the present invention relate generally to measurement while drilling data transmission technologies. More specifically, the embodiments relate to methods and apparatus for generating pressure pulse signals in a circulating drilling fluid. Still more specifically, the embodiments relate to methods and apparatus for using an electroactive fluid to create pressure pulse signals.

Modern petroleum drilling and production operations demand a great quantity of information relating to parameters and conditions downhole. Such information typically includes characteristics of the earthen formations traversed by the wellbore, data relating to the size and configuration of the wellbore itself, and information as to tool orientation, location, and operating parameters. Techniques used to measure conditions in the wellbore, including the movement and location of the drilling assembly, during drilling operations are commonly known as measurement-while-drilling (MWD) or logging-while-drilling (LWD).

These techniques often involve the use of a telemetry system that employs one or more sensors or transducers at the lower end of the drill string that collect data from the drill string or wellbore. These sensors relay the gathered information to an encoder that coverts the data to digital signals, which can be transmitted to receiving equipment at the surface. A commonly employed technique to relay signals from downhole to the surface is transmission of pressure pulses through the column of drilling mud that fills the borehole. These pulses are then received and decoded by a pressure transducer and computer at the surface.

In typical prior art mud pressure pulse systems, the pressure pulses in the drilling mud are created by means of a valve and control mechanism, generally termed a pulser or mud pulser. Mud pressure pulses are generated by opening and closing a valve, normally near the bottom of the drill string, so as to momentarily restrict or increase the mud flow. Early MWD tools used a "negative" pressure pulse that was created in the fluid by temporarily opening a valve in the drill collar allowing direct communication between the high pressure fluid inside the drill string and the fluid at lower pressure returning to the surface via the wellbore annulus. Negative pressure pulse techniques proved less than ideal because a failure in the valve could result in an uncontrolled release of drill string fluid into the annulus.

Alternatively, and often more preferably, a "positive" pressure pulse was created by temporarily restricting the flow of drilling fluid by partially blocking the fluid path in the drill string. Devices used to create these positive pressure pulses include poppets, sirens, and rotary pulsers.

Poppet-type pulsers operate like unidirectional check valves by permitting the flow of fluid in only one direction. The poppet employs an axially moveable plug to open and close a fluid pathway that, when closed, causes a pressure rise in the drilling fluid.

Sirens typically feature a stationary stator and a coaxially mounted, motor driven rotor. The stator and the rotor have a plurality of radially extending lobes such that when the lobes of the stator and the rotor are aligned, a fluid port is formed for the passage of fluid. As the rotor rotates, the flow of fluid is interrupted and pressure pulses are generated.

A rotary pulser is similar to a siren but rather than being driven to produce a relatively continuous series of signals like a siren, the actuation of a rotary pulser is controlled to produce a desired sequence of pulses in the drilling fluid. Thus, instead of the constant rotation of a siren, a rotary pulser is intermittently rotated a small amount to open and close fluid pathways.

Because all of these pulser designs operate by restricting the flow of drilling fluid through relatively small passageways, erosion and wear caused by the abrasive-laden drilling fluid is a serious concern. Drilling fluid normally contains some concentration of solid particles, which, at the pressure and flow rates typically encountered, tend erode the pulser components. Such erosion can lead to relatively short useful lives for many pulser components. Thus, there remains a need in the art for a pulser design exhibiting improved wear characteristics.

Disclosed in U.S. Pat. No. 2,661,596, the entire disclosure of which is hereby incorporated by reference, are electroactive fluids whose viscosity, or resistance to flow, is modifiable by subjecting the fluid to a magnetic or electric field. Electroactive fluids that are responsive to an electrical field are known as electrorheological (ER) fluids, while those responsive to magnetic fields are known as magnetorheological (MR) fluids. Of these two, MR fluids have proved easier to work with because they are less susceptible to performance-degrading contamination, and are easily controllable using magnetic fields easily created with either permanent magnets or electromagnets.

MR fluids can be formed by combining a low viscosity fluid, such as a type of oil, with magnetizable particles to form a viscous slurry. U.S. Pat. No. 2,661,596 used particles of iron on the order of 0.1 to 5 microns, with the particles comprising 20% or more by volume of the MR fluid. More recent work in MR fluids can be found, for instance, in U.S. Pat. No. 6,280,658, the entire disclosure of which is hereby incorporated herein by reference.

When a magnetic field passes through an MR fluid, the magnetizable particles align with the field, limiting movement of the fluid due to the arrangement of the magnetizable particles. As the field increases, the MR fluid becomes increasingly solid, but when the field is removed, the fluid reassumes its liquid state again. MR fluids have been used in such areas as dampers, locks, brakes, and abrasive finishing and polishing. MR fluids can be commercially obtained from the Lord Corporation of Cary, N.C.

The embodiments of the present invention are directed to methods and apparatus for generating a pressure pulse in drilling fluid using a pulser, controlled by an electroactive fluid, that seeks to overcome the limitations of the prior art.

SUMMARY OF THE PREFERRED EMBODIMENTS

The preferred embodiments provide a mud pulser controlled by a field applied to an electroactive fluid. The electroactive fluid is employed to act as a rapid-response brake to interrupt the rotation of the rotor of a mud motor or mud siren, thus creating pressure pulses in the circulating fluid. In certain embodiments, the electroactive fluid is used as a direct brake, acting on a shaft rotating in a volume of electroactive fluid where the shaft is coupled to the rotor. The application of a field to the electroactive fluid impedes the rotation of the shaft, thus slowing the rotor and creating a pressure pulse in the circulating fluid. In another embodiment, a Moineau pump circulating electroactive fluid is coupled to the rotor. The application of a field to the electroactive fluid slows the rotation of the pump, thus slowing the rotor and creating a pressure pulse in the circulating fluid.

In one embodiment, the pressure pulser comprises a first body rotated by flowing fluid and a second body rotatably coupled to the first body and at least partially disposed within an electroactive fluid. The pulser is actuated by applying a field to the electroactive fluid. The field causes the physical properties of the electroactive fluid to change, which affects the rotation of the second body.

In certain embodiments, the first body is a mud motor. The second body may be a shaft rotating in the electroactive fluid or a pump rotor circulating the electroactive fluid through a flowline having an electroactive fluid valve. Alternate embodiments may also comprise a mud siren where the rotation of the siren rotor is controlled by an electroactive fluid.

In an alternative embodiment, a method for generating a pressure pulse includes disposing a first body in a flowing fluid so as to rotate the first body, coupling the first body to a second body disposed in an electroactive fluid, and applying a field to the electroactive fluid. A magnetic field may be applied by applying a current to an electromagnetic coil or removing a shunt from a permanent magnet.

Thus, the present invention comprises a combination of features and advantages that enable it to provide for a mud pulser actuated by the intermittent application of a field to an electroactive fluid. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 2:
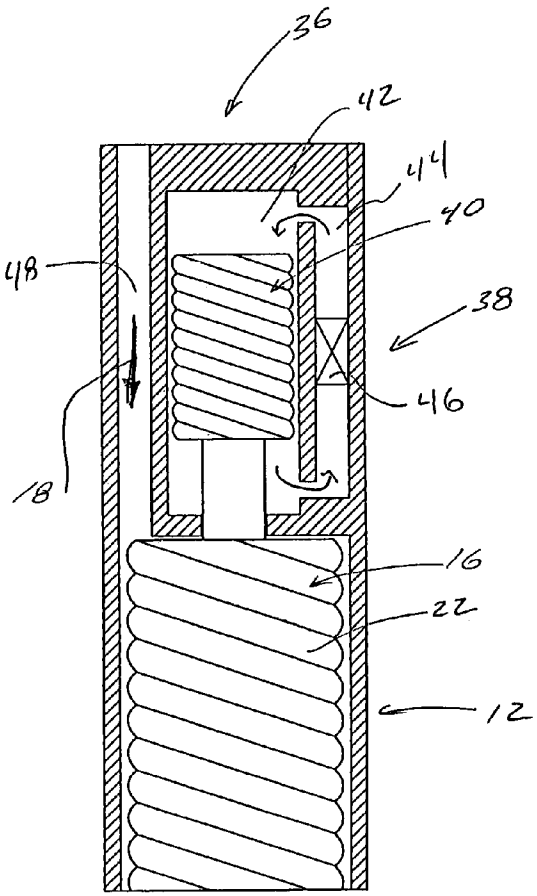
FIG. 2 is a schematic view of a second embodiment of an electroactive fluid controlled pulser.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

In particular, various embodiments of the present invention provide a number of different methods and apparatus for using an electroactive fluid to generate a pressure pulse in fluid. The concepts of the invention are discussed in the context of a mud pulser, but the use of the concepts of the present invention is not limited to this particular application and may be applied in other, downhole rotating mechanisms. The concepts disclosed herein may find application in other downhole tool applications, as well as other hydraulically actuated components, both within oilfield technology and other technologies to which the concepts of the current invention may be applied.

As used herein, an electroactive fluid is a fluid, gel, or other material having physical properties that change in response to a magnetic or electric field. Although the present invention is discussed relative to an MR fluid, an electrorheological (ER) or other electroactive fluid may be used without departing from the scope of this disclosure. It is understood that physical properties of an electroactive fluid can be changed by applying a magnetic field to an MR fluid or by applying an electrical field to an ER fluid.

A Moineau pump is a positive displacement or progressive cavity pump that includes a helical rigid rotor which rotates inside an elastic helical stator. The geometry and dimensions of these components are designed so that a double string of sealed chambers (or cavities) are formed when the rotor turns relative to the stator. These volumes within these chambers effectively move from one end of the pump to the other as the rotor rotates. A Moineau pump can be used as a pump by rotating the rotor or can be used as a motor by forcing fluid through the chambers, with the rotating rotor acting as an output shaft. Moineau pumps are commonly known in drilling applications as mud motors.

Figure 1:
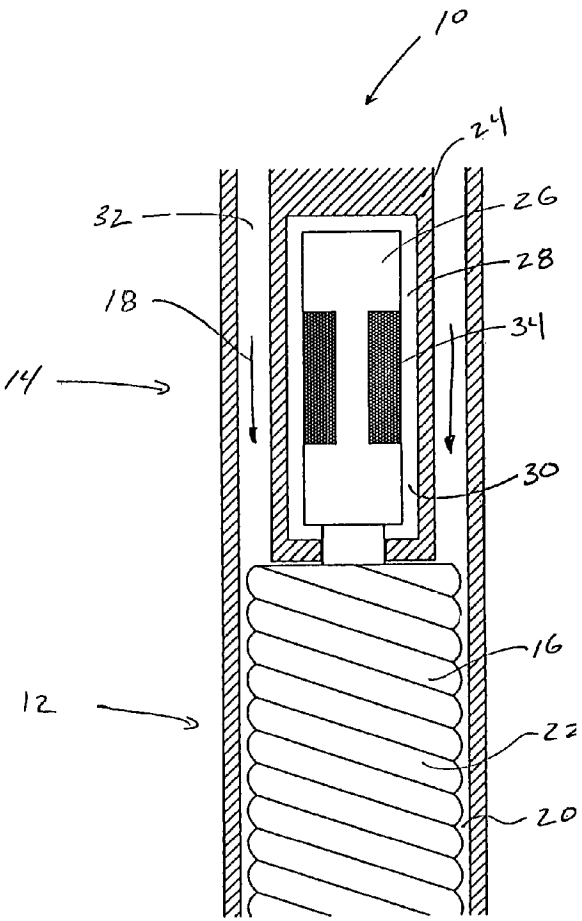
FIG. 1 is a schematic view of one embodiment of an electroactive fluid controlled pulser.

Referring now to FIG. 1, a pulser 10 is shown including a motor section 12 and a brake section 14. In the preferred embodiments motor section 12 and brake section 14 are a component of a drill string or integrated into a drilling tool or sub. The motor section 12 includes a mud motor 16 rotated by flowing drilling fluid, represented by arrows 18. Mud motor 16 is preferably a Moineau pump having a rubberized stator 20 and a metallic rotor 22 that rotates in response to pressurized fluid being applied to the pump. Brake section 14 includes a housing 24 containing a shaft 26 in a cavity 28 filled with an MR fluid 30. The MR fluid 30 is isolated from the drilling fluid 18, which flows through bypass ports 32 to motor section 12. Shaft 26 of brake section 14 includes an electromagnet coil 34 wound around the shaft that, when energized, creates a magnetic field in the MR fluid 30.

The application of a magnetic field to the MR fluid 30 cause the characteristics of the fluid to change from a liquid to a near solid. The coil can be powered with batteries, a generator that extracts its power from the flow, such as a turbine, or a generator that produces its own power from stored chemical energy, such as a fuel cell. This phase-shift of MR fluid 30, from viscous liquid to near-solid, increases the friction on the rotating shaft 26, which reduces the rotational speed of the shaft 26 and the coupled mud motor 16. The reduction in rotational speed of the mud motor 16 reduces the flow of drilling fluid 18 through the motor, causing a pressure increase in the drilling fluid that can be detected at the surface by conventional pressure pulse sensing and recording equipment.

Referring now to FIG. 2, a pulser 36 is shown including an alternative braking section 38 coupled with motor section 12. Braking section 38 includes a second Moineau pump 40 that is rotated by rotor 22. Pump 40 circulates an MR fluid 42 through flowline 44 that includes an MR valve 46. The MR fluid 42 is isolated from the drilling fluid 18, which flows through bypass ports 48 to motor section 12. MR valve 46 applies a magnetic field to the MR fluid 42 in flowline 44, which changes the characteristics of the fluid from a liquid to a near solid. The change of the viscosity of fluid 42 causes pump 40 to slow or stop rotating, which in turn slows motor 16, causing a pressure increase in the drilling fluid 18.

MR valve 46 operates by applying a magnetic field to a small area of flowline 44. The MR fluid 42 within this portion of the flowline changes from a liquid to a near solid and effectively blocks flow through the flowline 44. The magnetic field of MR valve 46 can be created by an electromagnet or a permanent magnet and many different MR valve designs are known in the art. A number of MR valve designs are disclosed in U.S. patent application No. 10/090,054 titled "Valve and Position Control using Magnetorheological Fluids," which is hereby incorporated by reference for all purposes.

Figure 3:
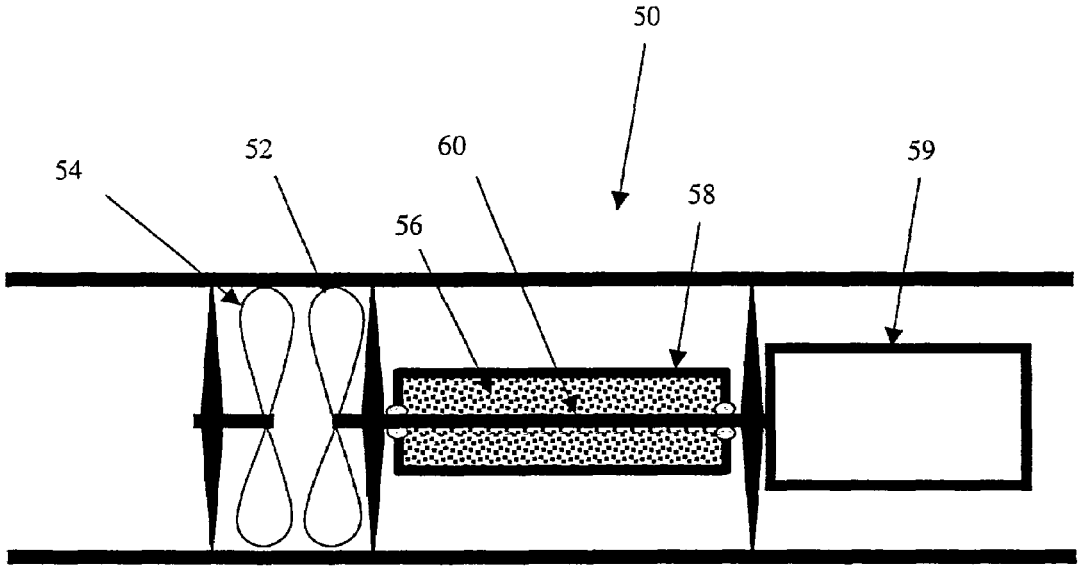
FIG. 3 is a schematic view of one embodiment of an electroactive fluid controlled mud siren.

Referring now to FIG. 3, one embodiment of a continuous wave telemetry system using a mud siren 50 controlled by an electroactive fluid is shown. Mud siren 50 includes a slotted rotor 52 and stator 54, which restrict the mud flow in such a way as to generate a modulating positive pressure wave that travels to the surface. Rotor 52 is mounted on a shaft 60, which rotates in a housing 58 containing an electroactive fluid 56. Thus, the electroactive fluid 56 can be used as the method through which the rotation of the rotor 52 is modulated. Activating an electric field across housing 58 solidifies the fluid 56 and causes rotor 52 to slow, which changes the frequency and/or phase of the rotor and creates a corresponding change in the continuous pressure wave. In certain embodiments, rotor 52 self-rotates, powered by flowing mud, while in other embodiments, it is driven by an electric or hydraulic drive motor 59. If rotor 52 is self-rotating, then fluid 56 acts as a brake. If rotor 52 is driven by drive motor 59, then fluid 56 acts as a clutch between the drive motor and the rotor.

As an alternative to electromagnet coil 34, the magnetic field needed to activate MR fluid 30 may also be created by a permanent magnet. While the electromagnetic coil 34 creates a magnetic field when a current is applied, a permanent magnet creates a permanent magnetic field and a magnetic circuit is used to control the application of the field to the MR fluid. Power is required only to operate the magnetic circuit switching mechanism and not to apply the magnetic field to the fluid. Thus, although potentially of greater mechanical complexity, employing a permanent magnet may potentially reduce the power required to create pressure pulses.

Figure 4A:
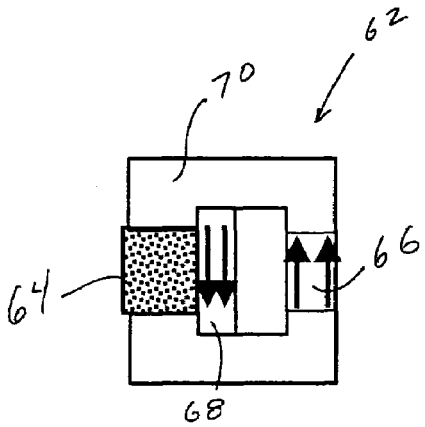
FIGS. 4A–4C are schematic views of alternative embodiments of permanent magnet circuits.

Referring now to FIG. 4A, one embodiment of a magnetic circuit 62 is shown. Circuit 62 includes MR fluid path 64, permanent magnet 66, moveable ferromagnetic bar 68, and flux path 70. Permanent magnet 66 creates a magnetic field that is transferred through flux path 70 to fluid path 64. To provide for an intermittent magnetic field, ferromagnetic bar 68 is placed across the flux path 70, effectively shifting the magnetic field from the fluid path 64 to the bar 68. Removing bar 68 allows the magnetic field to be applied to fluid path 64. Moveable ferromagnetic bar 68 may preferably be a rotating or oscillating disk having ferromagnetic portions.

Figure 4B:
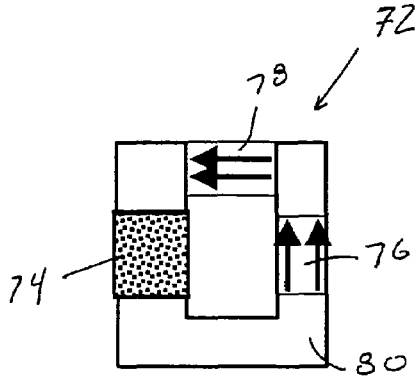

FIG. 4B shows an alternative permanent magnet circuit 72 including MR fluid path 74, permanent magnet 76, moveable member 78, and flux path 80. Permanent magnet 76 creates a magnetic field that is transferred through flux path 80 to fluid path 74. To provide for an intermittent magnetic field, member 78 is used to complete flux path 70, effectively completing the circuit to allow the magnetic field from magnet 76 to reach fluid path 74. Removing member 78 breaks the circuit and prevents the magnetic field from being applied to fluid path 74. Moveable member 78 may preferably be a rotating or oscillating disk having field transferring portions.

Figure 4C:
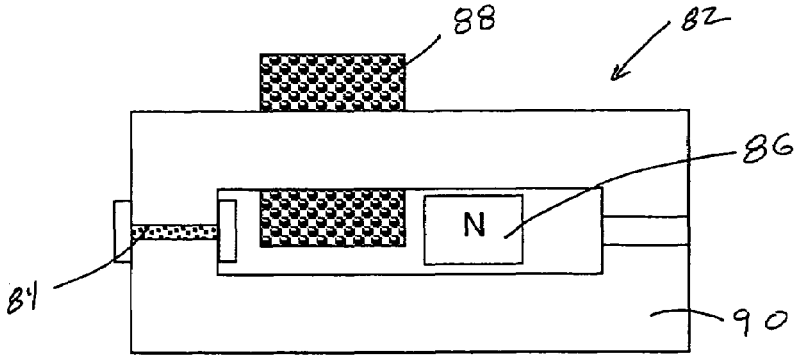

In an alternative embodiment as shown in FIG. 4C, a negative fluid pulser may be utilized including circuit 82. Circuit 82 includes MR fluid path 84, permanent magnet 86, electromagnet 88, and flux path 90. The permanent magnet 86 generates a constant magnetic field that solidifies the MR fluid in fluid path 84 when the power to the electromagnet 86 is off. Once power is applied to the electromagnet 86, the field generated by the electromagnet 86 cancels the field generated by the permanent magnet 84 and the MR fluid in fluid path 84 liquefies.

While MWD telemetry is sometime thought of as producing a single pulse, it actually produces two pulses. A first pulse propagates directly from the pulse generator up the mud column to the surface. Another pulse propagates downward and then reflects off of the bit. These two pulses can cause confusion at the surface. Because the use of an electroactive fluid provides excellent response times for a pulse generator, a feedback control could be included so that the two pulses constructively interfered with each other. For example, if the frequency of the generator is such that the travel time for the downward pulse corresponds to one wavelength of the frequency, then, upon reflection, that pulse will constructively interfere with the upward pulse and the combined pulse will have a larger amplitude. The combination of a feedback controller and an electroactive fluid could ensure that the two pulses constructively interfere during changes in the drilling environment.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A pressure pulser comprising:

a first rotatable body in fluid communication with a flowing fluid;

a second body coupled to said first body and at least partially disposed within an electroactive fluid, wherein said electroactive fluid is isolated from said flowing fluid; and a means for applying a field to the electroactive fluid.

2. The pulser of claim 1 wherein said first body is a mud motor.

3. The pulser of claim 1 wherein said second body comprises a shaft and said means for applying a field includes an electromagnetic coil.

4. The pulser of claim 1 wherein said second body is pump rotor circulating the electroactive fluid through a flowline.

5. The pulser of claim 4 further comprising a field-generating valve disposed on the flowline, wherein said valve has a blocked position where a field is applied to the flowline.

6. The pulser of claim 4 wherein the pulser is integrated into a drill string.

7. A method for generating a pressure pulse comprising:

disposing a first rotatable body in flowing fluid;

coupling the first body to a second body disposed in an electroactive fluid, wherein said electroactive fluid is isolated from said flowing fluid;

applying a field to the electroactive fluid.

8. The method of claim 7 wherein the field is applied by applying a current to an electromagnetic coil.

9. The method of claim 7 wherein the field is applied by a magnetic circuit.

10. The method of claim 7 wherein said first body is a mud motor.

11. The method of claim 7 wherein said second body comprises a shaft and an electromagnetic coil.

12. The method of claim 7 wherein said second body is pump rotor circulating the electroactive fluid through a flowline.

13. The method of claim 12 further comprising a field-generating valve disposed on the flowline, wherein said valve has a blocked position where a field is applied to the flowline.

14. The method of claim 7 wherein the first and second bodies are integrated into a drill string.

15. An apparatus for generating a pressure pulse in a column of circulating fluid, the apparatus comprising:

a first rotating member disposed in the column of circulating fluid;

a chamber containing an electroactive fluid isolated from the circulating fluid;

a second rotating member attached to said first rotating member and at least partially contained within said chamber of electroactive fluid;

a magnet proximate to said chamber of electroactive fluid and switchable between first and second states so as to apply a field to the electroactive fluid in the first state and not apply a field to the electroactive fluid in the second state.

16. An apparatus for generating pressure pulses in a column of circulating fluid, the apparatus comprising:

a housing adapted for communicating the circulating fluid therethrough;

a first body in said housing and adapted for rotation in the circulating fluid;

a chamber in said housing and enclosing an electroactive fluid; wherein said chamber is isolated from the circulating fluid;

a second body in said housing and connected to said first body; wherein said second body is at least partially disposed within said chamber and has an outer surface in contact with said electroactive fluid; and a magnet switchable between a first state applying a field to the electroactive fluid and a second state not applying a field to the electroactive fluid.

17. The apparatus of claim 16 wherein said first body is a mud motor.

18. The apparatus of claim 17 wherein said second body is a shaft.

19. The apparatus of claim 17 wherein said second body is a Moineau pump.

20. The apparatus of claim 16 wherein said magnet is an electromagnet.

21. The apparatus of claim 20 wherein said first body is a mud motor and said second body is a shaft.

22. The apparatus of claim 16 wherein said magnet is a permanent magnet.

23. The apparatus of claim 16 wherein said first body is a rotor and said second body is a shaft.

24. The apparatus of claim 23 wherein said second body extends through said chamber and is connected to a motor.

* * * * *